US005782670A

United States Patent [19]

Whisman

[11] Patent Number: 5,782,670

[45] Date of Patent: Jul. 21, 1998

[54] POST-OPERATIVE OPEN HEART SURGERY BRASSIERE

[76] Inventor: Mary K. Whisman, 3516 Atkinson Cir., North Vernon, Ind. 47265

[21] Appl. No.: 698,912

[22] Filed: Aug. 16, 1996

[51] Int. Cl.[6] ..... A41C 3/00; A41C 3/02; A41C 3/12

[52] U.S. Cl. ..... 450/1; 450/57; 450/58; 2/73

[58] Field of Search ..... 2/73, 267; 450/44, 450/43, 49, 51, 52, 53, 54, 55, 57, 58, 86

[56] References Cited

U.S. PATENT DOCUMENTS

| | | | |
|---|---|---|---|
| Re. 22,771 | 7/1946 | Licht | 450/52 |
| 165,842 | 7/1875 | Leetch | 450/43 X |
| 532,756 | 1/1895 | Bergheim | 450/57 |
| 1,664,926 | 4/1928 | Imershein et al. | 450/51 |
| 2,432,910 | 12/1947 | Licht | 450/52 |
| 2,883,988 | 4/1959 | Lee | 450/58 X |
| 3,040,750 | 6/1962 | Aurwitz | 450/58 |
| 3,094,125 | 6/1963 | Lewis | 128/483 |
| 3,256,886 | 6/1966 | Sachs | 128/483 |
| 4,638,513 | 1/1987 | Woods | 450/86 |
| 4,804,351 | 2/1989 | Raml et al. | 450/58 |
| 5,180,326 | 1/1993 | Williams | 450/91 |
| 5,281,186 | 1/1994 | Buckley et al. | 450/57 |

*Primary Examiner*—Jeanette E. Chapman
*Attorney, Agent, or Firm*—Woodard, Emhardt, Naughton Moriarty & McNett

[57] ABSTRACT

A post-operative open heart surgery brassiere in which a roll of padding material is sewn to the bottom edge of each cup. The padding roll has sufficient thickness to lift the connecting material or closure between the two cups above the surface of the chest, such that no portion of the brassiere touches the surgical wound. The brassiere is preferably formed with a front closure for ease of use and wide and/or padded straps for comfort. Additional padding material may be formed on the underside of the front closure in order to lessen the pain associated with any accidental contact between the closure and the wound, such as during bending or stretching.

11 Claims, 2 Drawing Sheets

POST-OPERATIVE OPEN HEART SURGERY BRASSIERE

TECHNICAL FIELD OF THE INVENTION

The present invention generally relates to clothing articles and, more particularly, to a post-operative open heart surgery brassiere.

BACKGROUND OF THE INVENTION

Many advances have been made in the past decades in the field of cardiac surgery in order to minimize the trauma experienced by the patient. For example, many blockages in the cardiac arteries may be corrected by a minimally invasive procedure known as percutaneous transluminal coronary angioplasty (PTCA), more commonly referred to as balloon angioplasty. Because PTCA only requires a small incision in the patient's groin for access to the arterial system, patient recovery time and post-operative discomfort are thereby minimized. There are, however, many types of cardiac surgery that still require the opening of the patient's chest cavity. These so-called open heart surgeries, such as bypass operations, involve cutting through the patient's breastbone (sternum) in order to gain access to the patient's chest cavity. After the surgeon has completed the operation on the patient's heart, the breastbone is sewn back together using surgical wires. The edges of the incision are then sewn together to close the chest. The wires in the breastbone remain in the patient forever, even after the incision has healed. Both the wires in the breastbone and the incision stitches remain extremely sore for weeks or months after the surgery. The wound is very tender and cannot stand any pulling or pressure. This presents a severe problem for female patients, especially those with large breasts. If the breasts are not restrained, their movement causes pulling of the skin and muscle tissue surrounding the wound, which is extremely painful and retards healing of the wound.

If the breasts are held in place by a brassiere, most of the pain from breast motion may be eliminated, but this is replaced by equally severe pain caused by the brassiere lying across the wound and applying pressure to the incision and the wires holding the breastbone together.

There is therefore a need for a way to restrict breast motion after open heart surgery in such a way that painful pressure is not applied to the wound. The present invention is directed toward meeting this need.

SUMMARY OF THE INVENTION

The present invention relates to a post-operative open heart surgery brassiere in which a roll of padding material is sewn to the bottom edge of each cup. The padding roll has sufficient thickness to lift the connecting material or closure between the two cups above the surface of the chest, such that no portion of the brassiere touches the surgical wound. The brassiere is preferably formed with a front closure for ease of use and wide and/or padded straps for comfort. Additional padding material may be formed on the underside of the front closure in order to lessen the pain associated with any accidental contact between the closure and the wound, such as during bending or stretching.

In one form of the invention, a post-operative open heart surgery brassiere for minimizing contact with a chest wound of the wearer is disclosed, comprising a pair of cups sized to receive the wearer's breasts; a band coupled to each cup and sized to lie across the wearer's back; a piece of connective material coupling the cups together between the breasts; and a pair of padding material rolls coupled to a bottom edge of each cup, wherein a height of each roll is operative to elevate the connective material above the chest so that the connective material is not in contact with the wound.

DETAILED DESCRIPTION OF THE PREFERRED EMBODIMENT

Figure 1:
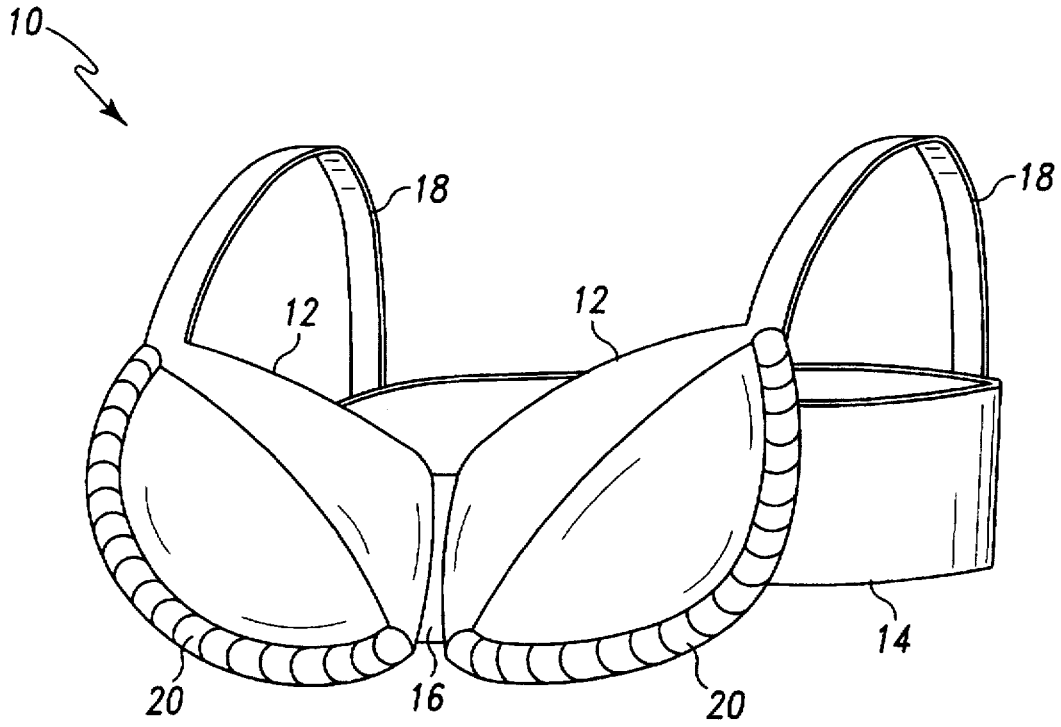
FIG. 1 is a perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a first embodiment post-operative open heart surgery brassiere of the present invention, indicated generally at 10. Most of the brassiere 10 is of standard construction, including the two cups 12 and the elasticized band 14. The two cups 12 are joined by a strip of material 16, which is preferably a closure such as a hook and eye closure, a velcro closure, or any other closure known in the art. A front closure 16 is preferred for the present invention as it minimizes the effort required to put on or take off the brassiere 10. The brassiere 10 further includes a pair of straps 18 which couple to the cups 12 and to the elasticized band 14. It is preferred that the straps 18 be formed with a width of ½ inch or greater in order to provide comfortable support. Additionally, the straps 18 may be padded.

Figure 2:
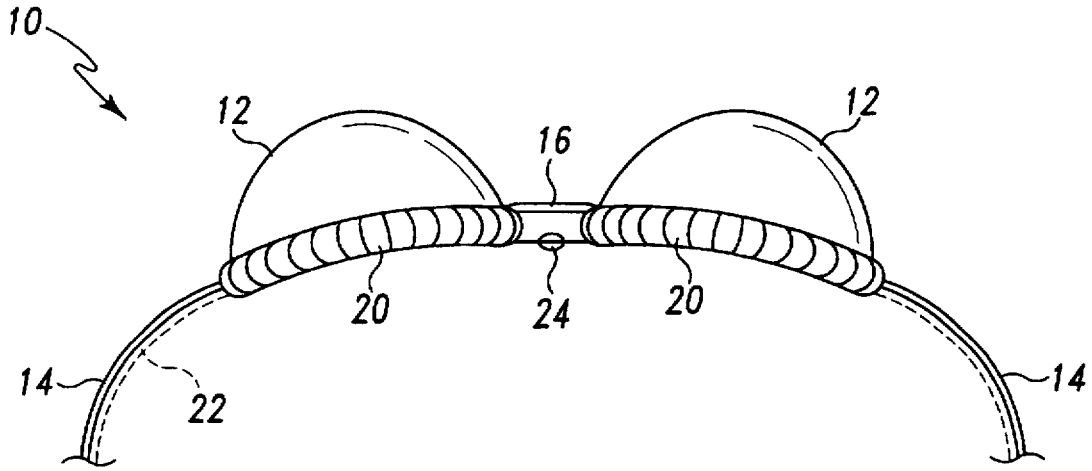
FIG. 2 is a bottom end view of the first embodiment of the present invention.

A roll of padding material 20 is either sewn to the bottom edge of each cup 12 or integrally formed therewith. In a preferred embodiment, the roll 20 is formed from a heavy, absorbant cotton material (such as the material commonly used to manufacture sweatshirts) which is rolled around the bottom edge of the cup 12 and then covered with a cotton fabric shell. The height of the roll 20 is preferably at least one-quarter of an inch. The function performed by the padding rolls 20 is illustrated in FIG. 2, in which the underside of the brassiere 10 is viewed while situated upon a wearer 22. Visible at the surface of the chest of the wearer 22, between the cups 12, is a wound 24 resulting from a open heart surgery procedure. The wound 24 includes a stitched incision as well as metal wires tying the patient's breastbone together. As shown in the view of FIG. 2, the height of the padding rolls 20 raises the level of the closure 16 above the surface of the chest so that there is normally no contact between the closure 16 and the wound 24. Because of the separation between the closure 16 and the wound 24, it is possible for women to comfortably wear the brassiere 10 after open heart surgery, whereas most patients could not tolerate wearing a prior art brassiere due to the contact between the closure 16 and the wound 24. Thus, the brassiere 10 of the present invention allows the breasts to be stabilized in order to keep them from pulling upon the incision 24, while at the same time the brassiere 10 does not provide any irritation to the wound 24. The brassiere 10 of the present invention therefore provides increased post-operative comfort to the wearer, and it promotes faster healing of the wound 24.

Figure 3:
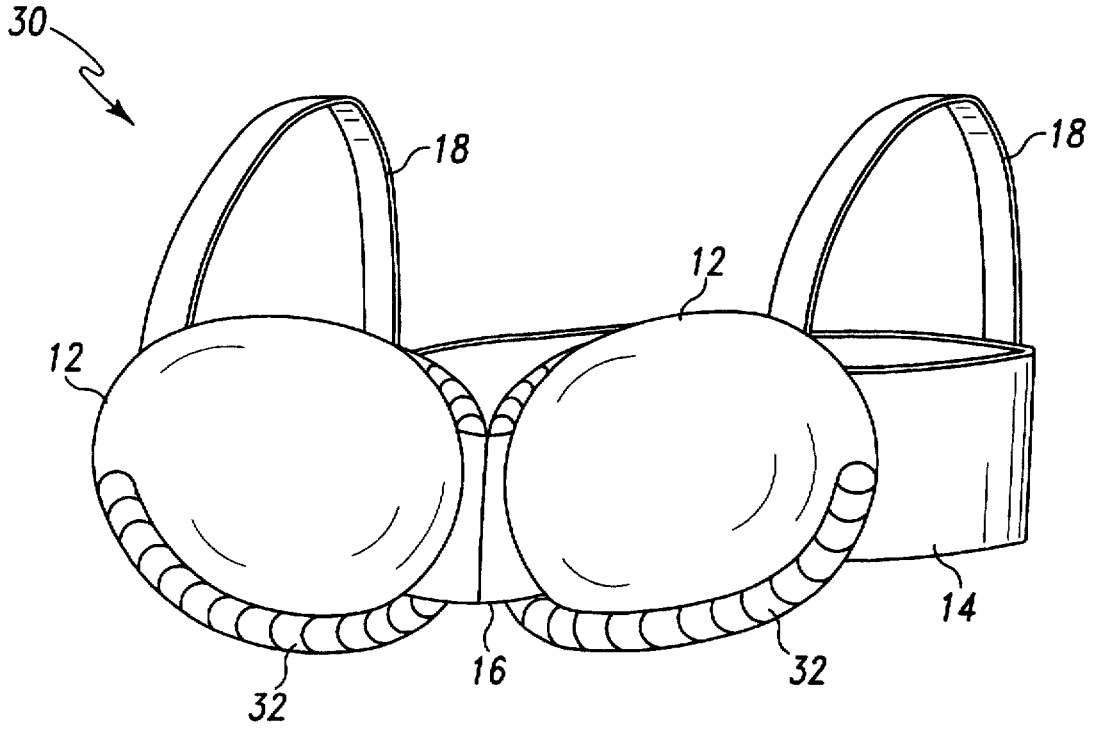
FIG. 3 is a perspective view of a second embodiment of the present invention.

Referring now to FIG. 3, a second embodiment brassiere of the present invention is illustrated and indicated generally at 30. The brassiere 30 is similar to the brassiere 10, with the exception that the brassiere 30 includes a padding roll 32 on each cup 12 which extends along the inside edge of each breast to substantially near the top of each cup 12. The padding rolls 32 perform the same function performed by the padding rolls 20, namely raising the level of the closure 16 above the chest. However, the padding rolls 32 perform a further function by providing further support along the inside edge of each breast in order to keep the breast from rolling over onto the wound 24. This provides further protection to the wound 24. In general, the present invention comprehends placement of the padding 20, 32 at any point along the edge of the cups 12, so long as the closure 16 is thereby elevated above the surface of the wound 24. In either the brassiere 10 or 30, it may be found that certain positions or movements of the wearer will cause momentary contact between the closure 16 and the wound 24. In order to minimize the pain associated with these brief contacts, a layer of padding material may be placed on the side of the closure 16 which faces the wound 24. By adding such a layer of padding material, the pain associated with such brief contacts between the closure 16 and the wound 24 is thereby minimized.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A post-operative open heart surgery brassiere for minimizing contact with a chest wound of the wearer comprising:

a pair of cups sized to receive the wearer's breasts;

a band coupled to each cup and sized to lie across the wearer's back;

a piece of connective material coupling the cups together between the breasts; and a pair of cloth padding material rolls coupled to a bottom edge of each cup, wherein a height of each roll is operative to elevate the connective material above the chest so that the connective material is not in contact with the wound.

2. The brassiere of claim 1, wherein the piece of connective material comprises a front closure for the brassiere.

3. The brassiere of claim 2, wherein the front closure comprises a hook and eye closure.

4. The brassiere of claim 1, wherein the height is at least one-quarter of an inch.

5. The brassiere of claim 1, wherein the rolls are integrally formed with the cups.

6. The brassiere of claim 1, further comprising:

a pair of straps coupling each cup to the band and lying over the wearer's shoulders.

7. The brassiere of claim 6, wherein the straps are padded.

8. The brassiere of claim 6, wherein each of the straps are at least one-half inch wide.

9. The brassiere of claim 1, wherein the band is elastic.

10. The brassiere of claim 1, further comprising:

a layer of padding coupled to a side of the piece of connective material that faces the wound.

11. The brassiere of claim 1, wherein each padding material roll extends along an inside edge of each cup in an area between the cups.

* * * * *